United States Patent [19]

Yasushi et al.

[11] 4,067,284

[45] Jan. 10, 1978

[54] BARGE-CARRYING SHIP

[75] Inventors: Nishino Yasushi, Akashi; Adachi Saburo, Nishinomiya; Karashima Koji, Kobe; Iwai Ken, Yokohama, all of Japan

[73] Assignee: Mitsubishi Jukogyo Kabushiki Kaisha, Tokyo, Japan

[21] Appl. No.: 656,163

[22] Filed: Feb. 9, 1976

[30] Foreign Application Priority Data

Mar. 26, 1975 Japan ..... 50-35331

[51] Int. Cl.[2] ..... B63B 35/40

[52] U.S. Cl. ..... 114/260; 214/15 R

[58] Field of Search ..... 114/72; 214/15 R, 12–14, 214/390; 212/3

[56] References Cited

U.S. PATENT DOCUMENTS

| | | | |
|---|---|---|---|
| 3,437,066 | 4/1969 | Schwendtner | 114/260 |
| 3,515,085 | 6/1970 | Auzins | 114/260 |
| 3,552,344 | 1/1971 | Wilson | 114/260 |
| 3,687,309 | 8/1972 | Macrander | 214/15 R |
| 3,756,446 | 9/1973 | Macrander | 214/15 R |

FOREIGN PATENT DOCUMENTS

| | | | |
|---|---|---|---|
| 307,004 | 7/1971 | U.S.S.R. | 114/260 |

*Primary Examiner*—Trygve M. Blix
*Assistant Examiner*—Stuart M. Goldstein

[57] ABSTRACT

A barge-carrying ship having a crane at the end of the vessel for lifting barges from the water surface, a plurality of openings at the end of the vessel through which the barges are carried aboard the ship, and rails laid in the fore-and-aft direction on the upper deck and along the inner walls of the both sides of the hull for the transportation of the lifted barges to the points where they may be stowed. Barge trucks are provided equipped with low-lift hydraulic jacks for raising and lowering the loads thereon. The barge trucks are distributed at the rate of at least one such truck per track of one or a pair of the rails. Supports protrude inwardly from the inner walls of the both sides of the ship for supporting the barges. The ship has no deck in the hold space except for a middle deck over engine rooms. A second crane is mounted substantially amidships. The ship has stern doors hinged openable to both sides and associated with a plurality of openings at the rear end of the ship in such a manner that, when closed, the doors cover the openings fluidtightly and, when open, they are unmovably secured to the both sides of the ship.

8 Claims, 5 Drawing Figures

BARGE-CARRYING SHIP

BACKGROUND OF THE INVENTION

This invention relates to an improvement of a barge-carrying ship.

Conventional barge-carrying ships are roughly divided into two types, i.e., the LASH type which handles barges by a traveling crane on the deck and the SEA BEE type which relies on a trolley on the deck for barge handling. The former is limited in the number of barges that can be carried aboard the vessel because of the hatch covers and various other obstructive structures on the deck. Moreover, the barge handling efficiency is low with a single traveling crane, and the high initial investment of the crane makes the installation uneconomical. The latter renders it impossible to make use of the space below the lower deck and to shift the barges from level to level within the holds. Still further, the sorting of the barges by the destinations of their cargoes is made difficult by the inadequate deck space available, and the deck structure is a limiting factor for the accommodation of barges.

The present invention contemplates the provision of a barge-carrying ship for overcoming these problems in conventional vessels of the character described.

SUMMARY OF THE INVENTION

According to a feature of the invention, the barge-carrying ship comprises deck-leg gantries stationarily installed at the stern and substantially amidships. Stern doors are hingedly secured to openings at the rear end of the hull so as to close the openings fluidtightly or open toward and fastened to the both sides of the hull. The doors are provided with rails on the upper ends thereof and rails are laid on the upper deck, on a middle deck which partitions the engine rooms from the hold, on the inner bottom of the vessel and on a pair of brackets on at least a single level opposedly and symmetrically protruding inward from the inner walls of the both sides of the hold and extending longitudinally of the ship. Trucks equipped with low-lift means for raising and lowering the loads thereon, adapted to travel on said rails are distributed at a rate of at least one such truck per set of rails on each of the different levels. Barge supports are provided extending longitudinal of the hull and protrude inward from the inner walls of both sides of the hull and of the upper deck above the rails. An opening is formed in the upper deck to provide a craning region for the amidship deck-leg gantry. All of the rails are laid on the same gauge throughout.

The above and other objects, features, and advantages of the invention will become more apparent from the following description taken in conjunction with the accompanying drawings.

DESCRIPTION OF THE INVENTION

Figure 1:
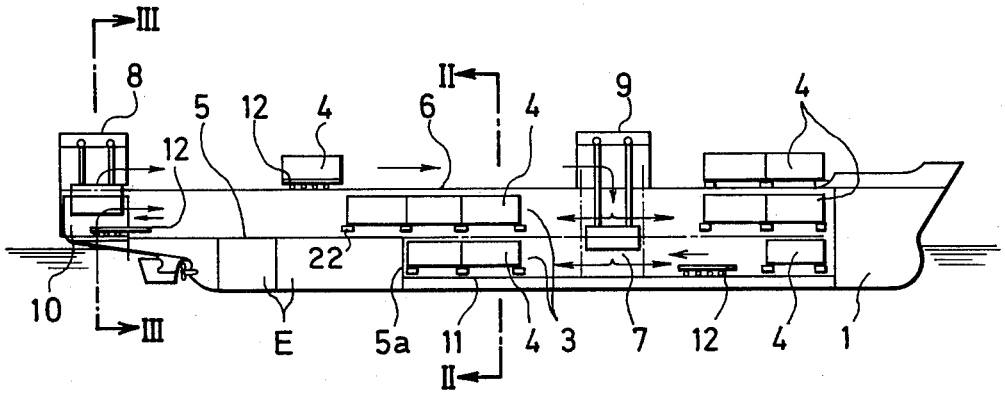
FIG. 1 is an inboard profile of an embodiment of the invention.
Figure 2:
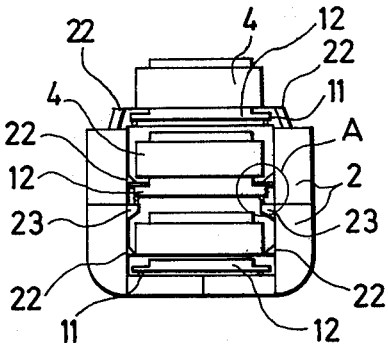
FIG. 2 is a section through the line II-II of FIG. 1.
Figure 3:
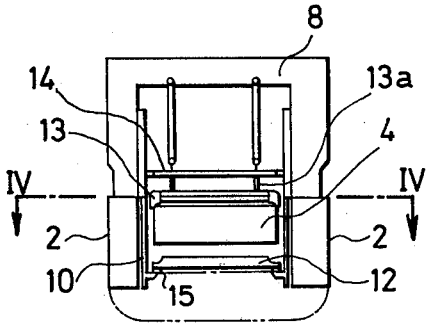
FIG. 3 is a section through the line III-III of FIG. 1.
Figure 4:
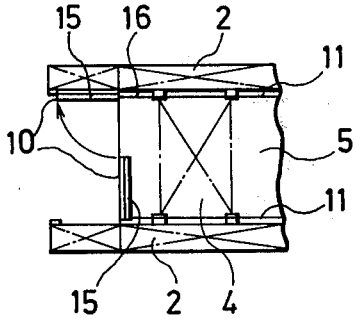
FIG. 4 is a section through the line IV-IV of FIG. 3.

FIGS. 1 through 5 illustrate an embodiment of the invention. The hull of a ship, generally indicated at 1 in FIG. 1, has double-hull sections 2 at both sides as will be seen from FIG. 2. These sections are bulkheaded, though not shown, at proper intervals across the fore-and-aft direction of the hull 1. The double-hull construction of the both sides which reinforces the hull 1 longitudinally and transversely, permits the omission of lower decks and transverse bulkheads in the open hold space, and enables the vessel to secure adequate buoyancy and stability in case of any flooding of the hold due to damage. A unified hold 3, formed between the upper deck 6 and the bottom, does have neither the transverse bulkheads nor lower decks that are the necessary adjuncts to the conventional ships of this character. Engine rooms E on the stern bottom are isolated from the hold 3 by a middle deck 5 and a transverse bulkhead 5*a*. Practicaly in the middle of the hull 1, a stationary, deck-leg gantry 9 is mounted over almost the entire breadth of the ship, and its lifting beams are adapted to move into and out of a craning region 7 within the hold 3 through an only opening formed in the upper deck 6. As shown in FIG. 3, another deck-leg gantry 8 spans over almost the total breadth of the stern of the hull 1. The gantry includes lifting beams 13 and guide beams 14, with link-type shock absorbers 13*a* disposed therebetween. Stern doors 10 provided on a stern opening of the hull 1 are equipped with drives not shown, so that they can be opened together or separately on hinges as shown in FIG. 4. When closed, the doors 10 provide a fluidtight end cover and seal for the hull 1 and, when open, they are fastened unmovably to the inner surfaces of the both sides of the hull. On the upper ends of the bi-parting stern doors 10 there are provided rail sections 15 which, when the doors are opened and fastened to the both sides, assume the same gauge as inboard rails 11 to be described later.

The inboard rails 11 are laid in the fore-and-aft direction on the upper deck 6, middle deck 5, and the bottom, and also in the hold 3. Inside the last-mentioned space (hold 3) the rails lie over brackets 23 symmetrically provided on the inner walls of the double-hull sections 2 on the both sides of the ship (FIG. 2). The rails 11 in the hold 3 are installed on a plurality of levels at suitable intervals vertically depending on the depth of the hold 3. (In the embodiment being described, the rails 11 are shown on a single level, aligned to those on the middle deck 5.)

Figure 5:
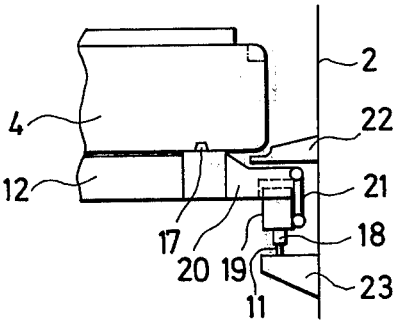
FIG. 5 is an enlarged view of the encircled portion A of FIG. 2.

Reference numeral 12 designates self-propelled trucks, each powered by an independent drive, adapted to run on the rails 11. The truck 12 comprises a pair of side bogies 19, each having a plurality of running wheels 18, a truck frame 20 connecting the side bogies together, and low-lift jack means such as fluid-pressure cylinders 21 mounted between the side bogies and frame (FIG. 5). By actuating the cylinders 21 to have their piston rods extended or retracted, the truck frame 20 can be raised or lowered with respect to the side bogies 19 to a suitable height without inclination. On the four upper corners of the truck frame 20, there are four upward protrusions 17 adapted to mate with corresponding recesses formed in the four corner portions of the underside of each barge 4. Alternatively, the protrusions 17 may be eliminated and replaced by the fluid-pressure cylinders 21, so that the barge 4 in place of the truck frame may be raised or lowered. The built-in drives of the trucks 12 are operated by signals from remote controls not shown aboard the ship, whereby the trucks are caused to travel on the rails 11 or stop at desired points.

The trucks 12 may be either of the self-propelled type as above described or of a wire-driven type. At least one such truck is placed on the rails 11 of each level of the ship.

The brackets 23 project horizontally and inwardly from the inner walls of the double-hull sections 2 on both sides of the vessel, on three different levels, e.g., at the upper deck 6, middle deck 5, and in the hold 3. Like the brackets 23, barge supports 22 protrude horizontally and inwardly in a parallel and symmetrical arrangement. The barge supports 22 may take the form of either projections provided at suitable intervals or continuous lengths of inward protrusions oriented fore and aft.

Numeral 16 in FIG. 4 indicates movable intermediate rails for joining the rails 15 on the stern doors 10 to the inboard rails 11.

In moving barges into the ship according to the invention, the ship is first anchored at a designated point on the sea, and the stern doors 10 are swung open and fastened to the both sides of the vessel. Next, each barge 4 afloat is hoisted to a suitable height by the lifting beams 13 of the stern deck-leg gantry 8. The pitch and roll of the barge adrift are absorbed by the link type shock absorbers 13*a* disposed between the lifting beams 13 and guide beams 14 of the gantry, and the barge is lifted steadily and safely. The rails 15 on the stern doors 10 are coupled to the inboard rails 11 of the middle deck 5 and in the hold 3 by means of the movable intermediate rails 16. A truck 12 on the rails 11 of either the middle deck 5 or the hold 3 is driven abaft to the loading position beneath the gantry 8 and therefore under the barge in lifted position. The lifting beam 13 of the gantry 8 are lowered until the barge rests on the truck 12, with the protrusions 17 on the four corners of the truck frame 20 fitted snugly in the corresponding recesses on the underside of the barge. After this, the truck frame 20 is raised by the fluid-pressure cylinders 21 to a sufficient height to clear the barge and truck from interference wih the barge supports 22 protruding inwardly from the both sides of the ship. The loaded truck 20 is then allowed to travel on the rails 11 within the middle deck 5 or within the hold 3, thus carrying the barge 4 to a desired point aboard the vessel. Following the stoppage of the truck 12, the fluid-pressure cylinders 21 are actuated in the manner reverse to the procedure already described to lower the truck frame 20 until the barge 4 rests on the supports 22 on the both sides. In this way the barge 4 has now been carried into and stowed in place either on the middle deck 5 or in the hold 3.

When stowing the barge 4 on the upper deck 6, it is only necessary to repeat the afore-described procedure, this time with a truck 12 on the rails 11 of the upper deck 6 and thereby allow the barge to rest on the barge supports 22.

When shifting any barge 4 from the upper deck 6 to the middle deck 5 or into the hold 3 or vice versa, the truck frame 20 of a truck 12 on the particular level is lifted to take over the barge from the supports 22 of the particular level, and the truck is driven to a designated point below the amidship gantry 6. Next, the barge is slightly lifted by means of the lifting beams of the gantry, and the unloaded truck 12 is moved out of the hoisting region of the beams. Following this, a truck 12 belonging to the level on which the barge is to be stowed is brought to the position below the gantry 9, and the barge is placed onto this truck and carried to the desired point on the desired level, and finally it is supported in the desired position by the barge supports 22 of the particular level in the same manner as already explained.

When the barge thus resting on the supports 22 on a particular level is to be taken out of the ship, the procedure described above may be reversed.

In any case, the stern and amidship gantries 8, 9 and the trucks 12 on the different levels can operate independently of one another. It is therefore possible, for example, that the stern gantry 8 works to the fullest extent of its capacity, lifting barges from the water surface and transferring them one after another onto the trucks from the different levels, while the loaded trucks travel efficiently to carry the barges through the amidship gantry 9 to desired stowage points on the barge supports 22.

The lifting beams of the stationary gantries 8, 9 in the stop positions and the truck frames 20 of the individual trucks 12 raised or lowered to the up or down positions are detected by appropriate detector means. Desirably, arrangements are made so that, in case of any irregularity made known by a detection signal from such means, the particular operation is stopped and an alarm is given. As for the relative motions of the gantries 8, 9 and the trucks in the craning regions of the gantries, it is desirable that proper interlock means be provided to avoid any mutual interference of those motions and preclude any trouble due to erroneous motion.

The embodiment of the invention shown in FIGS. 1 to 5 has advantages as follows:

i. The upper deck 6 has practically no opening or structure except for the opening through which the stationary deck-leg gantry 9 amidships can reach out in its craning region 7. Also, inside the hull there is only a partial middle deck 5 that partitions the engine rooms E. This spacious construction permits the carriage of a much larger number of barges than on the conventional ships designed for barge transportation.

ii. The initial investment on the stationary gantries is less than that on the traveling ones. Moreover, without any shifting of the crane weight, changes in the trim (i.e., the inclination or difference between the draft at the bow and that at the stern) are minimized and the ship is balanced stably.

iii. The barge handling capacity is much greater than heretofore because the stationary gantries 8, 9 at the stern and at the middle of the vessel and the trucks on the different levels can operate independently of one another, the gantries handling the barges vertically and the trucks 12 handling the craft horizontally.

iv. Since the amidship gantry 9 permits transfer of barges from level to level, shifting of barges throughout the different levels is possible and trimming of the craft by the destinations of the cargoes they carry is easy.

What is claimed is:

1. A barge carrying ship comprising a hull having at least an upper deck, sides and a unitary open hold having a bottom deck, at least one opening provided at the stern of said hull for access to said hold, first lifting means located at the stern of said hull for moving barges to and from said deck and said hold, rail pairs laid from said stern lifting means in the fore and aft direction on the upper deck, the bottom deck and along the inner walls of the sides of said hull, truck means located above and within said hull movable along said rail pairs for transporting said barges, said truck means comprising a pair of side bogies and transversely connecting frame extending beneath said barges, jack means located on said side bogies for raising and lowering said trucks and the barges thereon and stationary supports spaced above said rail pairs and protruding inwardly between said truck means and the barges thereon to support said barges in stowed accommodation upon lowering of said jack means.

2. The barge carrying ship according to claim 1 including at least one door for closing said stern openings in fluid tight condition, said doors being hingedly secured to said hull to be movable into an open position against the sides of said hull and having means for securing said doors in the open position, said doors having rail pairs aligned with the rail pairs of the hull.

3. The barge carrying ship according to claim 1 wherein at least one truck means is provided for each rail pair.

4. The barge carrying ship according to claim 1 wherein a plurality of rail pairs are located within said hold, said pairs being arranged at spaced vertical intervals along the sides of said hull, each of said rail pairs having the same track gauge.

5. The barge carrying ship according to claim 4 wherein said rail pairs are mounted on brackets which are secured on the walls of said sides and extend inwardly therefrom.

6. The barge carrying ship according to claim 1 including a hatch opening amidship and a second lifting means located at said hatch for moving barges to and from said upper deck and said hold.

7. The barge carrying ship according to claim 6 wherein said first and second lifting means comprises stationary cranes having means for supporting said barges and means for receiving said truck means below said barges to lift the barges therefrom.

8. The barge carrying ship according to claim 1, wherein said hold is provided with a middle deck extending in part therein and overlying the ship engine room.

* * * * *